US006452339B1

(12) United States Patent
Morrissey et al.

(10) Patent No.: US 6,452,339 B1
(45) Date of Patent: Sep. 17, 2002

(54) PHOTOCONTROLLER DIAGNOSTIC SYSTEM

(75) Inventors: Joseph F. Morrissey, Rockland; Jeff Walters, Marshfield, both of MA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/461,983

(22) Filed: Dec. 15, 1999

Related U.S. Application Data

(63) Continuation-in-part of application No. 08/914,661, filed on Aug. 19, 1997, now Pat. No. 6,028,396.

(51) Int. Cl.[7] ..... H05B 37/02
(52) U.S. Cl. ..... 315/149; 315/119; 315/159
(58) Field of Search ..... 315/119, 149–159, 315/360, 362, 120, 291, 224, 307; 362/1, 4, 5

(56) References Cited

U.S. PATENT DOCUMENTS

| | | | | | |
|---|---|---|---|---|---|
| 4,042,853 | A | | 8/1977 | Duve | 315/155 |
| 4,207,500 | A | | 6/1980 | Duve et al. | 315/119 |
| 4,473,779 | A | | 9/1984 | Lindner et al. | 315/119 |
| 4,587,417 | A | | 5/1986 | Duve et al. | 315/360 |
| 4,731,551 | A | * | 3/1988 | Gibbs et al. | 315/159 |
| D322,598 | S | | 12/1991 | DiCarlo, Jr. | D13/165 |
| D322,776 | S | | 12/1991 | DiCarlo, Jr. | D13/165 |
| 5,103,137 | A | * | 4/1992 | Blake et al. | 315/119 |
| 5,195,016 | A | | 3/1993 | Powers | 361/175 |
| 5,235,252 | A | | 8/1993 | Blake | 315/151 |
| 5,357,170 | A | * | 10/1994 | Luchaco et al. | 315/159 |
| 5,469,347 | A | | 11/1995 | Duve et al. | 362/245 |
| 5,479,159 | A | * | 12/1995 | Kelly et al. | 315/119 |
| 5,557,207 | A | | 9/1996 | Duve | 324/414 |
| 5,894,175 | A | * | 4/1999 | Berlin et al. | 315/159 |
| 5,895,986 | A | * | 4/1999 | Walters et al. | 315/159 |
| 6,119,076 | A | * | 9/2000 | Williams et al. | 315/133 |

* cited by examiner

*Primary Examiner*—Don Wong
*Assistant Examiner*—Wilson Lee
(74) *Attorney, Agent, or Firm*—Geoff L. Sutcliffe, Esq.; Kilpatrick Stockton LLP

(57) ABSTRACT

A photocontroller diagnostic system including a photocontroller with a sensor for determining the presence of daylight, and a relay, responsive to the sensor, for de-energizing a lamp during periods of daylight. The diagnostic subsystem is responsive to the photocontroller, and includes a microprocessor programmed to verify the operability of the relay and/or the sensor and programmed to transmit a signal representative of the operability of the relay or the sensor.

16 Claims, 7 Drawing Sheets

CYCLING DETECTION

PHOTOCONTROLLER DIAGNOSTIC SYSTEM

RELATED APPLICATIONS

This application is a continuation-in-part application of Ser. No. 08/914,661 entitled "Luminaire Diagnostic System" filed Aug. 19, 1997 now U.S. Pat. No. 6,028,396.

FIELD OF THE INVENTION

This invention relates to a photocontroller diagnostic system which, inter alia, detects whether the photocell and the relay of the photocontroller are faulty and which also provides an indication of a faulty relay or photocell condition by transmitting information about that condition to a remote base station and/or illuminating a signal light on the photocontroller.

BACKGROUND OF THE INVENTION

Photocontrollers are typically mounted on street lights and operate to turn the light off during the day and on at night. Since the cost of servicing a single street light can cost $100 or more on busy roads and in busy areas, and since there are 60,000,000 street lights in the United States alone, the problem of servicing faulty photocontrollers is severe. For example, when the relay of the photocontroller fails, or when the photocell fails, the street light will remain on during periods of daylight thereby wasting electricity. Alternatively, a faulty relay or a faulty photocell could cause the lamp to remain off during the night causing a safety hazard. Since repair typically occurs during daylight hours, it is often difficult to detect the latter condition.

The problem of high pressure sodium (HPS) street lights cycling at the end of their useful life is also severe. The phenomena of cycling of HPS lamps as they age from use is caused by some of the electrode material being plated off the electrodes and then being deposited on the inside of the arc tube. This makes the tube darken and traps more heat inside the arc tube. As a result, an increased voltage is required to keep the lamp ignited or ionized. When the voltage limit of the ballast is reached, the lamp extinguishes by ceasing to ionize. Then, the lamp must cool down for several minutes before an attempt at re-ignition can be made. The result is "cycling" wherein the worn out lamp keeps trying to stay lighted. The voltage limit is reached, the lamp extinguishes, and then after an approximately one-two minute cool down period, the arc tube re-ignites and the light output increases again and until the voltage limit is reached whereupon the lamp again extinguishes.

Cycling may waste electricity, cause RFI (radio frequency interference) which adversely effects communication circuits, radios, and televisions in the area, and may adversely effect and prematurely wear out the ballast, starter, and photocontroller.

For example, if an HPS lamp undergoes cycling for a many nights before it is finally serviced and replaced, the ballast or starter can be damaged or degraded. But, when the HPS lamp is replaced, this damage or degradation might not be detected. Later service calls then must be made to service these problems. The ballast and starter components are more expensive than the lamp or the photocontroller.

The cycling problem is well documented but so far the only solutions offered are to replace the HPS lamps with less efficient mercury lamps or to reconfigure existing photocontrollers with a special fiber optic sensor which senses light from the lamp and sends a signal to a microprocessor to indicate whether the lamp is on or off. After three on/off cycles, the microprocessor turns the lamp off and turns on a red strobe light which can be seen from the street. Unfortunately, this prior art solution requires modifications to the existing light fixture (e.g. a hole must be drilled in the fixture housing) and the use of an expensive fiber optic sensor. See, e.g., U.S. Pat. No. 5,235,252.

Another problem with all luminaries including HPS or other types of lamps is the cost involved in correcting the cycling problem and other faults such as a lamp out condition. For example, a resident may report a lamp out or a cycling condition but when the repair personnel arrives several hours later, the lamp may have cycled back on. Considering the fact that the lamp pole may be 25–35 ft. high, repair personnel can waste a considerable amount of time checking each lamp in the area. Also, repair and maintenance personnel may not be able to service a given residential area until daylight hours when all of the street lights are off by design.

SUMMARY OF INVENTION

It is therefore an object of this invention to provide a photocontroller diagnostic system and method.

It is a further object of this invention to provide such a photocontroller diagnostic system which detects and reports a faulty photocell and/or relay of the photocontroller to aid repair personnel in repairing failed photocontrollers.

It is a further object of this invention to provide such a photocontroller diagnostic system which conveniently resides on a microprocessor which itself is a component of the photocontroller.

It is a further object of this invention to provide a luminaire diagnostic system which, inter alia, detects and reports cycling street lights.

It is a further object of this invention to provide a method of monitoring luminaries such as street lights.

It is a further object of this invention to provide such a system and method which, because of its ability to detect cycling, saves electricity, reduces RFI, and prevents the premature failure of ballasts and starters associated with luminaries.

It is a further object of this invention to provide such a system and method which significantly reduces the cost of servicing and repairing luminaries such as street lights.

It is a further object of this invention to provide such a system and method which can be implemented in a cost effective way without the need for making complicated modifications to existing luminaries and/or the use of expensive fiber optic sensors.

It is a further object of this invention to provide such a system and such a method which provides a positive indication of a cycling or lamp off condition in real time.

It is a further object of this invention to provide a combined photocontroller and luminaire diagnostic system which is a part of the photocontroller and which detects a failed photocontroller relay, a failed photocontroller photocell, a failed lamp, and a cycling lamp condition.

This invention results from the realization that the proper operation of a photocontroller for a street lamp or other luminaire can be diagnosed by a microprocessor resident on the photocontroller and programmed to detect a faulty relay by reading whether current is drawn by the lamp during daylight hours and also programmed to detect a faulty photocell by determining whether the lamp remains continuously on or off for a present period of time such as twenty four hours.

This invention results from the further realization that cycling of a street light and other faulty luminaire conditions such as a lamp out condition can be detected by monitoring the load drawn by the lamp at different times and then comparing the load differences to pre-determined thresholds, that such detection can be accomplished by an inexpensive transformer added to the photocontroller circuitry and coupled to a specially programmed microprocessor, and that a transmitter can be linked to the microprocessor to transmit lamp out, lamp cycling, and other fault conditions to a location remote from the street lamp to initiate repair/maintenance services in real time. Alternatively, the microprocessor can illuminate one or a series of LEDs resident on the photocontroller to provide repair personnel with a positive indication regarding the condition of the photocontroller and/or lamp even in the daylight hours when the lamp is purposefully turned off. Further, the controller can shut the lamp off after a predetermined number of cycles. This feature eliminates ballast and starter degradation.

This invention features a photocontroller diagnostic system comprising a photocontroller including a sensor for determining the presence of daylight, and relay means, responsive to the sensor, for de-energizing a lamp during periods of daylight. A diagnostic subsystem is responsive to the photocontroller and includes: means for verifying the operability of at least one of the relay means and the sensor, and means, responsive to the means for verifying, for transmitting a signal representative of the operability of the relay means or the sensor.

The relay means typically includes a switch which when activated energizes a relay to present a voltage to the lamp. The means for verifying may include programming steps operable on a microprocessor which detect whether current is being drawn by the lamp during daylight hours to detect a faulty relay. The means for transmitting then preferably includes additional programming steps which send a relay fault signal when current is being drawn during daylight hours.

Alternatively, or in addition, the means for verifying includes programming steps, operable on a microprocessor, which detect whether the lamp is on or off for a period of time greater than a preset threshold to detect a faulty sensor. The means for transmitting then includes additional programming steps which send a sensor fault signal when the lamp is on or off for a period of time greater than the preset threshold (e.g., twenty four hours).

The diagnostic subsystem preferably includes a microprocessor which is a component of and integral with the photocontroller and programmed to detect a faulty relay and/or a faulty sensor (e.g., a photocell).

Further included are indicator means, responsive to the signal representative of the operability of the relay means or the sensor, for providing an indication of the operability of the relay means or the sensor means. Such as indicator means includes one or more visual alarms such as LED's on the photocontroller. Alternatively, the indicator means may include a transmitter for transmitting the fault signals to a remote location.

The photocontroller diagnostic system of this invention may be combined with a luminaire diagnostic system which includes means for determining the operability of one or more components of the luminaire; and means, responsive to the means for determining, for transmitting a signal representative of the inoperability of the components of the luminaire, typically a failed lamp condition, and/or a cycling lamp condition. Such a combined luminaire and photocontroller diagnostic system comprises: a photocontroller circuit for automatically turning a lamp on during periods of darkness and off during periods of daylight; means for detecting a load drawn by the lamp; a microprocessor, responsive to the means for detecting, programmed to detect a condition of the lamp based on the load drawn by the lamp, and programmed to detect a condition of the photocontroller based on the load drawn by the lamp; and means, responsive to the microprocessor, for indicating the occurrence of a detected condition.

The programming which predicts a condition of the lamp based on the load drawn by the lamp and includes processing steps which reads the load shortly after the lamp is turned on then again after predetermined time, calculates the load difference, and determines whether the load difference exceeds a predetermined threshold to detect a failed lamp condition.

The programming which predicts a condition of the lamp based on the load drawn by the lamp may also include processing steps which calculates whether the load difference at predetermined times exceeds a predetermined threshold, and counts the number of times the load difference exceeds said predetermined threshold to detect a cycling lamp condition.

The programming which predicts a condition of the photocontroller based on the load drawn by lamp includes processing steps which detect whether current is drawn by the lamp during daylight hours to detect a relay fault condition.

The programming which predicts a condition of the photocontroller based on the load drawn by lamp may also include processing steps which detect whether the lamp is on or off for a period of time greater than a preset threshold to detect a photocell fault condition.

Usually, the load drawn by the lamp is used as the input to determine whether the lamp has failed or is cycling and also to determine whether the photocontroller relay and/or photocell components are faulty. Such a photocontroller diagnostic system comprises a photocontroller for automatically turning a lamp on during periods of darkness and off during periods of daylight; means for detecting a load drawn by the lamp; a microprocessor, responsive to the means for detecting, programmed to determine a condition of the photocontroller based on the load drawn by the lamp; and means, responsive to the microprocessor, for indicating the presence of a failed photocontroller. The microprocessor further includes programming which determines a condition of the lamp based on the load drawn by the lamp. The programming which determines a condition of the lamp based on the load drawn by the lamp and includes processing steps which read the load shortly after the lamp is turned on then again after predetermined time, calculate the load difference, and determine whether the load difference exceeds a predetermined threshold to detect a failed lamp condition. The programming which determines a condition of the lamp based on the load drawn by the lamp may also or alternatively include processing steps which calculate whether the load difference at predetermined times exceeds a predetermined threshold, and counts the number of times the load difference exceeds the predetermined threshold to detect a cycling lamp condition.

The programming which determines a condition of the photocontroller based on the load drawn by lamp includes processing steps which determine whether current is drawn by the lamp during daylight hours to detect a relay fault condition. The programming which determines a condition of the photocontroller based on the load drawn by lamp may also or alternatively include processing steps which determine whether the lamp is on or off for a period of time greater than a preset threshold to detect a photocell fault condition.

This invention also features a method of diagnosing the operability of photocontroller components such as the relay and/or the photocell sensor. The method includes detecting whether a load is drawn by a lamp; determining whether it is daylight; determining whether the load is continuously drawn by the lamp for a period of time greater than a preset threshold; and sending a fault signal if a load is drawn by the lamp during daylight or if a load is drawn by the lamp for a period of time greater than the preset threshold. The method of this invention also includes diagnosing whether the lamp is properly operating. The method includes reading the load shortly after the lamp is turned on then again after predetermined time, calculating the load difference, and determining whether the load difference exceeds a predetermined threshold to detect a failed lamp condition. In addition, a cycling lamp condition may be detected by calculating whether the load difference at predetermined times exceeds a predetermined threshold, and counting the number of times the load difference exceeds the predetermined threshold to detect a cycling lamp condition.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
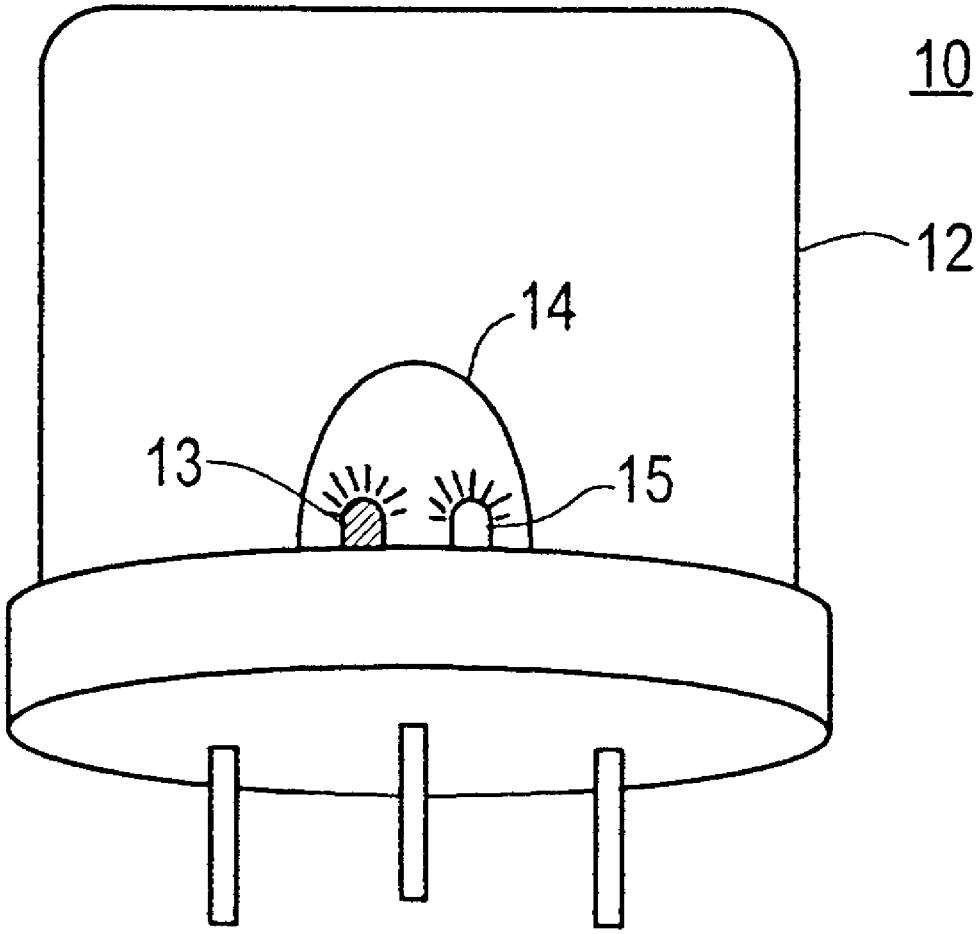
FIG. 1 is a schematic view of a photocontroller including both the photocontroller diagnostic and the luminaire diagnostic systems of this invention.

Photocontrol device 10, FIG. 1, includes thermoplastic, high impact resistant, ultraviolet stabilized polypropylene cover 12 and clear window 14 made from UV stabilized, UV absorbing, acrylic for the light sensor which resides on a circuit board within cover 12. Photocontrol device 10 is typically configured to fit an ANSI C136.10 receptacle but may be mounted in an ANSI C136.24 "button" package or other enclosure. Photocontroller 10 is typically mounted on a street light at the top of a light pole. Photocontroller 10 may also be used, however, in conjunction with other types of luminaries and other devices such as golf course water fountains.

Figure 2:
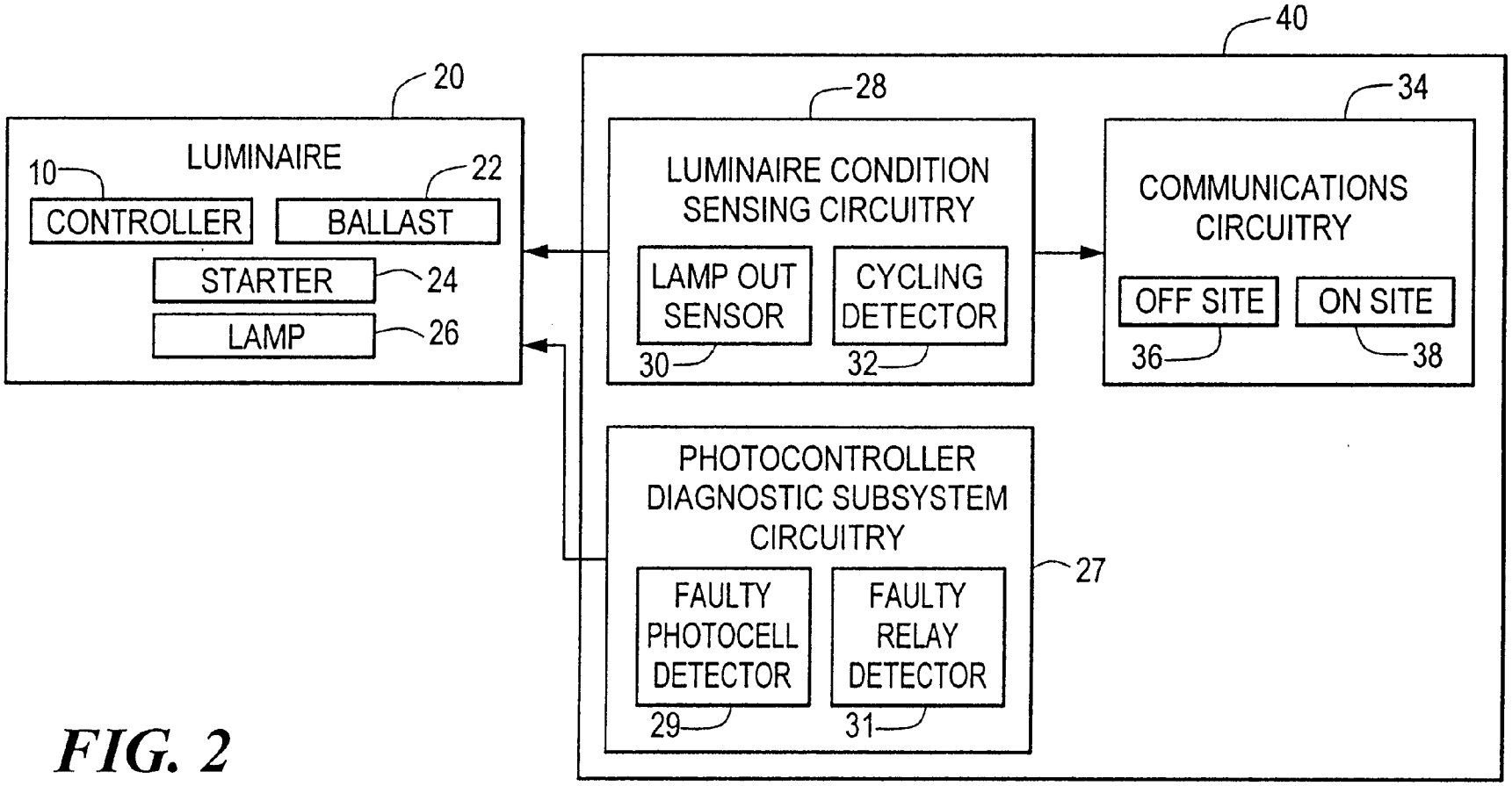
FIG. 2 is a block diagram of the primary components of the photocontroller and luminaire diagnostic systems of this invention.
Figure 3:
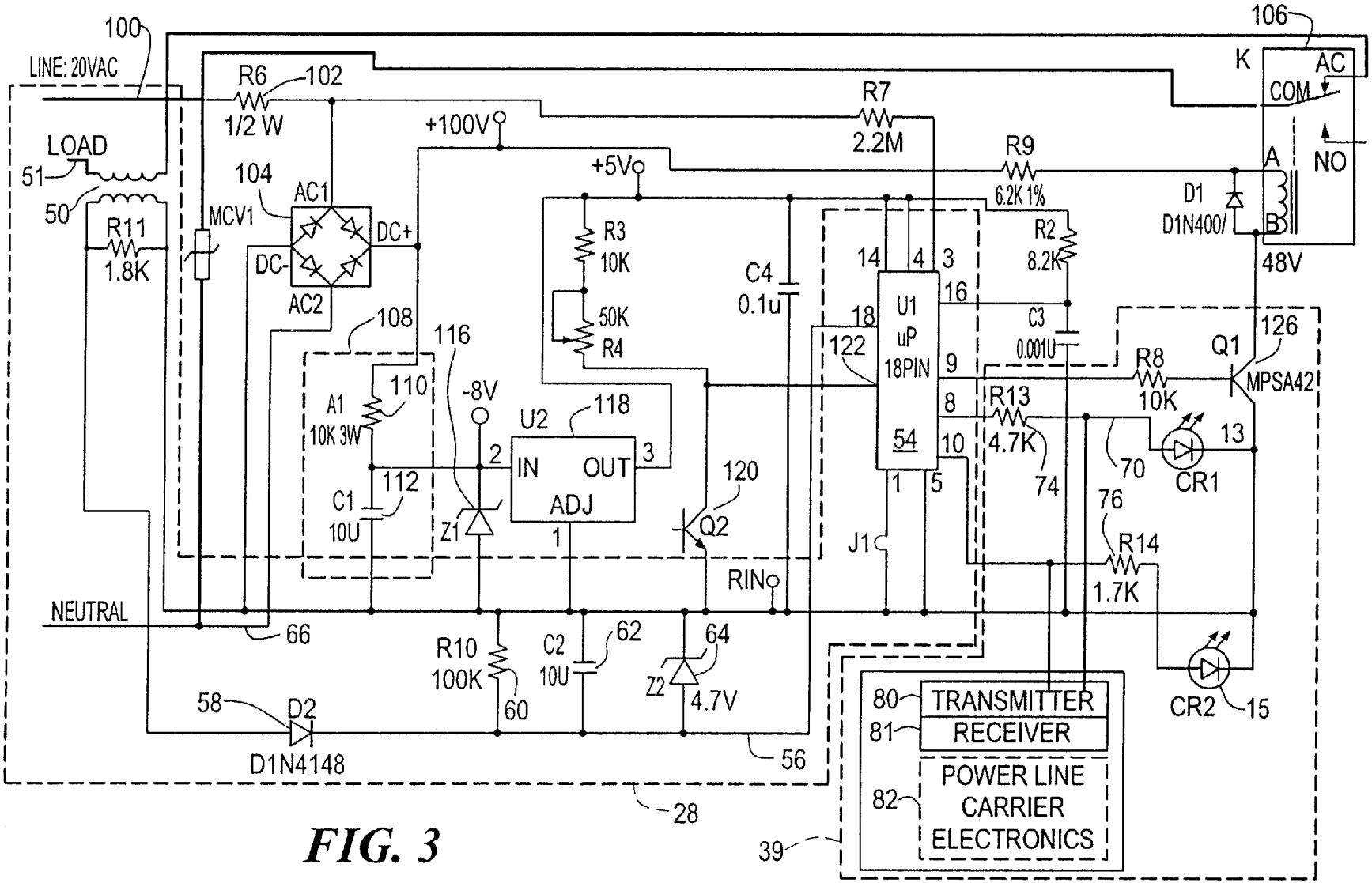
FIG. 3 is a wiring diagram showing the primary components of the photocontroller and luminaire diagnostic systems of this invention.
Figure 8:
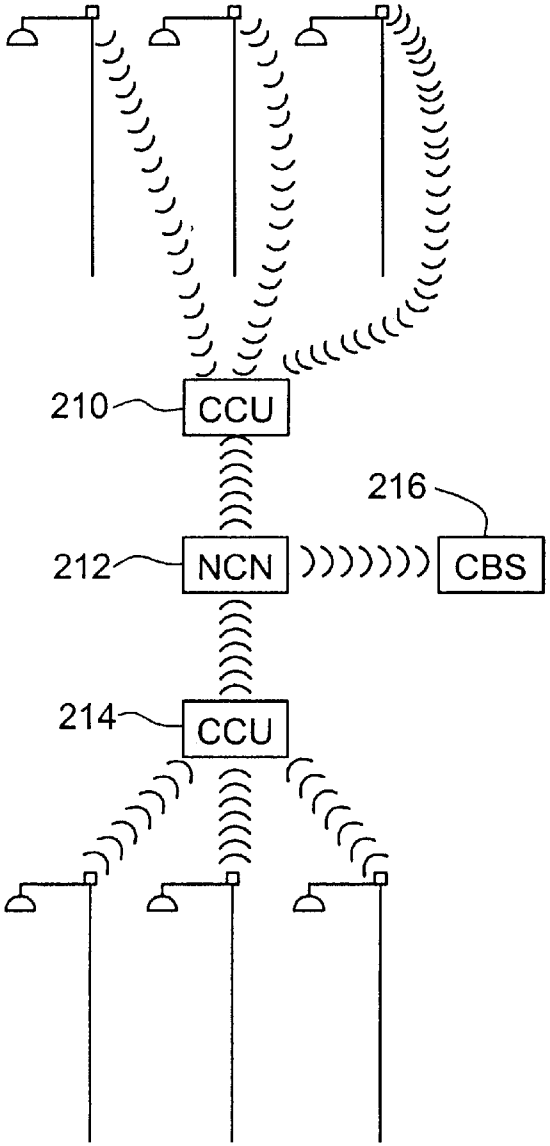
FIG. 8 is a schematic view showing another method of externally transmitting photocontroller and luminaire fault conditions in accordance with the subject invention.

The circuit board within cover 12 is configured to operate in accordance with the block diagram shown in FIG. 2 and the specific circuit diagram shown in FIG. 3. Microcontroller 54 shown in the circuit diagram of FIG. 3 is programmed in accordance with the flow charts shown in FIGS. 4, 5, and 6 in accordance with this invention, and transmitter 80 shown in the circuit diagram of FIG. 3 can be linked to a communications network or networks as shown in FIGS. 7 and 8 in accordance with this invention.

A standard street light type luminaire 20, FIG. 2, typically includes a controller such as controller 10, FIG. 1, ballast 22, starter or igniter 24, and a HPS or other type of lamp 26. Lamp 26 is generally referred to as an electrical device.

Photocontroller diagnostic subsystem circuitry 27 and luminaire condition sensing circuitry 28 in accordance with this invention may be integral with photocontroller 10, FIG. 1. Photocontroller diagnostic subsystem circuitry 27 includes faulty photocell detector 29 and faulty relay detector 31. Luminaire condition sensing circuitry 28 includes lamp out sensor circuitry 30 and cycling detector circuitry 32. In the preferred embodiment, faulty photocell detector 29, faulty relay detector 31, lamp out sensor circuitry 30, and cycling detector circuitry 32 all uniquely share the same electronic components discussed with reference to FIG. 3. Faulty photocell detector 29 and faulty relay detector 31 operate, in the preferred embodiment, as means for verifying the operability of the relay of the photocontroller and also the operability of the light sensor, typically a photocell, of the photocontroller. There are also means for sensing a condition of luminaire 20 such as a lamp out condition or a cycling condition, namely luminaire condition sensing circuitry 28. Also a part of the present invention are transmitter means such as communication circuitry 34 which may include off-site remote communications subsystem 36 and/or on-site communications subsystem 38 which may simply be visual indicator means such as LED 13, FIG. 1 of one color for indicating the occurrence of a cycling condition or a faulty photocell condition and LED 15 of another color for indicating the occurrence of a lamp out condition or a faulty relay condition. The LED's may also be made to flash to indicate a faulty photocontroller and be steady on to indicate a cycling or lamp out condition. Off-site communication circuitry 36 may also be implemented to transmit these and other conditions to remote location for real time diagnostics.

Thus, luminaire diagnostic system 40 which includes condition sensing circuitry 28, diagnostic circuitry 27, and communication circuitry 34 eliminates the guess work involved, especially in the day time, when repair personnel attempt to determine which street light and/or a photocontroller has a faulty component. The cost of servicing street lights is severely reduced in part because the guess work of on-site diagnosing of problems with the street light systems is eliminated.

Photocontroller diagnostic subsystem circuitry and luminaire condition sensing circuitry 28, FIG. 3, includes means for detecting the load drawn by the lamp such as transformer 50 coupled to load line 51 and connected to microprocessor 54 via line 56. A hall effect sensor could also be used as it is functionally equivalent to transformer 50. Microprocessor 54 predicts a faulty photocontroller relay and/or a faulty photocontroller photocell in accordance with programming described with reference to FIG. 4. Microprocessor 54 also predicts a lamp out and/or lamp cycling condition in accordance with programming described with reference to FIGS. 5 and 6. Diode 58 is located on line 56 to rectify the current from transformer 50. Resistor 60, capacitor 62, and Zener diode 64 are connected across line 56 and neutral line 66 to filter and stabilize the current. Capacitor 62 filters the rectified AC current present on line 56 and typically has a value of 10 $\mu$F. Resistor 60 has a typical value of 100 kΩ and acts as a bleeder for capacitor 62. Zener diode 64 acts to limit the voltage to microprocessor 54 and has a typical value of 4.7 volts at one watt. Microprocessor 54 then transmits signals over lines 70 and 72 through resistors 74 and 76 which limit the current output current (typical values are 4.7 kΩ) to LEDs 13 and 15, respectively.

Alternatively, or in addition, transmitter 80 may be connected to microprocessor 54 and used to transmit signals indicative of photocontroller and/or lamp conditions sensed by photocontroller diagnostic circuitry and sensing circuitry 28 to a remote location as discussed infra via RF communications. Alternatively, such communication signals may be placed back on the power line to which the lamp is connected via power line carrier electronics package 82. Microprocessor 54 is preferably an 18 pin microprocessor part no. PIC16C710 or an eight pin PIC12C671 with an analog to digital converter capability available from Microchip. Much of the remainder of the circuitry shown in FIG. 3 is described in general in U.S. Pat. No. 5,195,016 incorporated herein by this reference. Specifically, 120 volt AC line 100 is fed to resistor 102 (1 kΩ) which is used to limit the current to bridge rectifier 104. Bridge rectifier 104 rectifies the AC current to a rippled 100 VDC presented to relay 106 and resistor/capacitor filter network 108. Resistor 110 has a typical value of 10 kΩ and capacitor 112 has a typical value of 10 $\mu$F. RC filter network 108 filters the rippled DC signal to a smooth DC signal and Zener diode 116 clamps the voltage at 8 volts DC. Regulator 118 receives this 8 volt VDC signal and maintains a constant 5 volt DC signal to microprocessor 54. When light is sensed by the sensor, e.g., photocell 120, the voltage level on pin 1, 122 of microprocessor 54 will vary inversely with the light level. When the light level is high (daylight) the voltage is low and when the light level is low (night time) the voltage is high. Program variables in the programming of microprocessor 54 make it possible to select what light level will turn on switch 126 which in turn energizes relay 106 and also the light level which will turn off switch 126 which in turn de-energizes relay 106.

Figure 4:
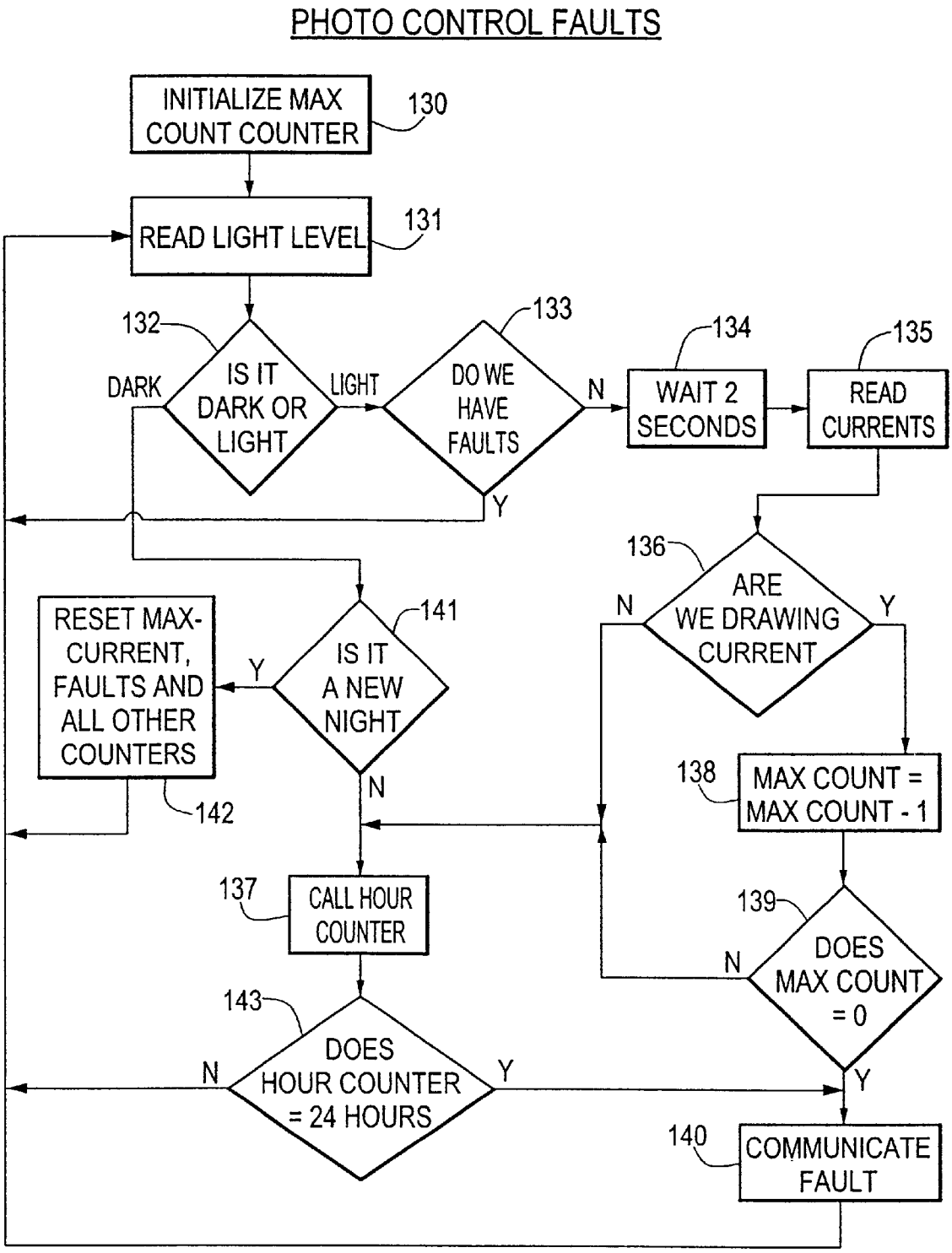
FIG. 4 is a flow chart depicting the program steps for detecting a faulty photocell and a faulty relay in accordance with the subject invention.
Figure 5:
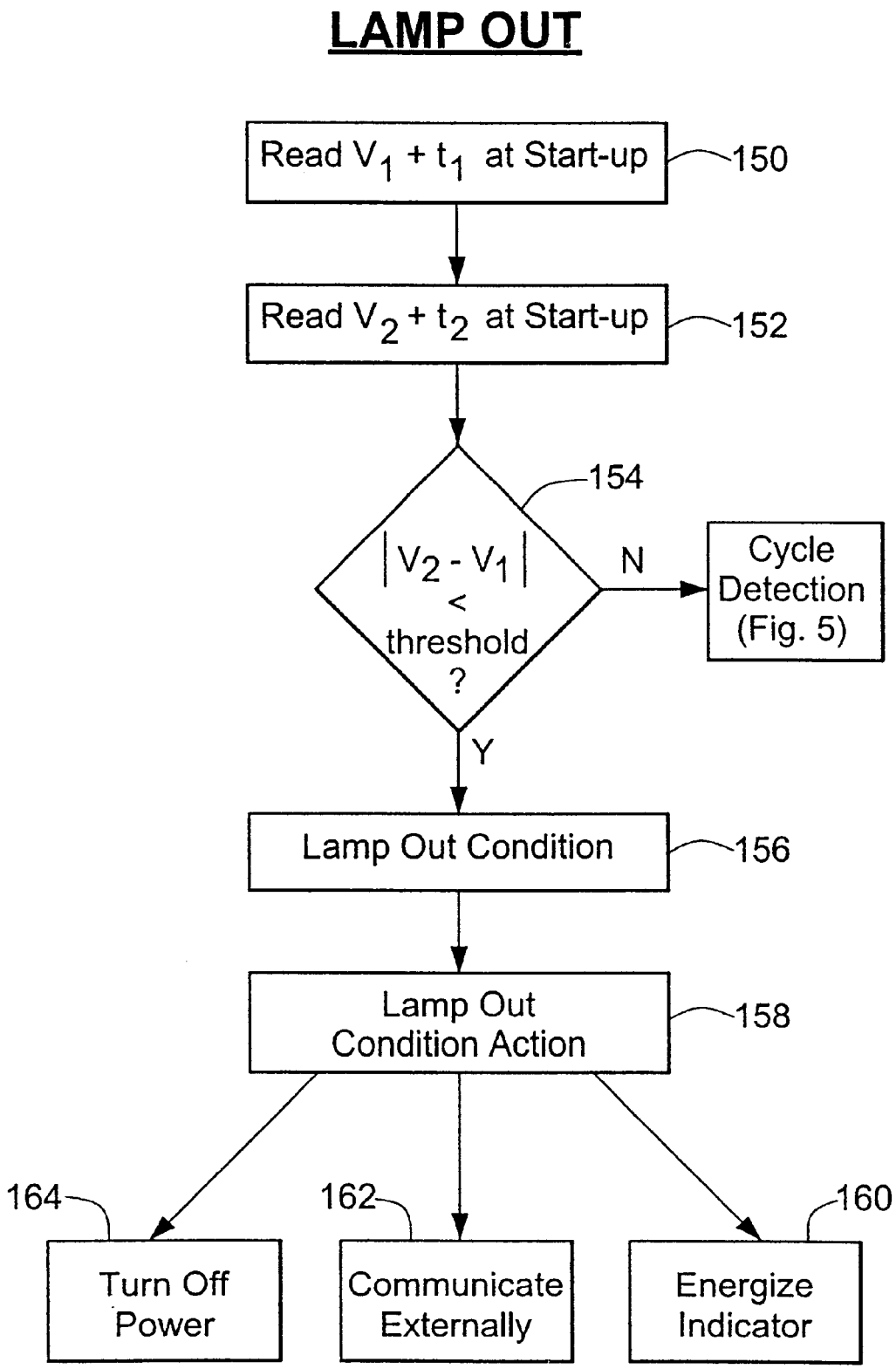
FIG. 5 is a flow chart depicting the routine for detecting a lamp out condition in accordance with this invention.
Figure 6:
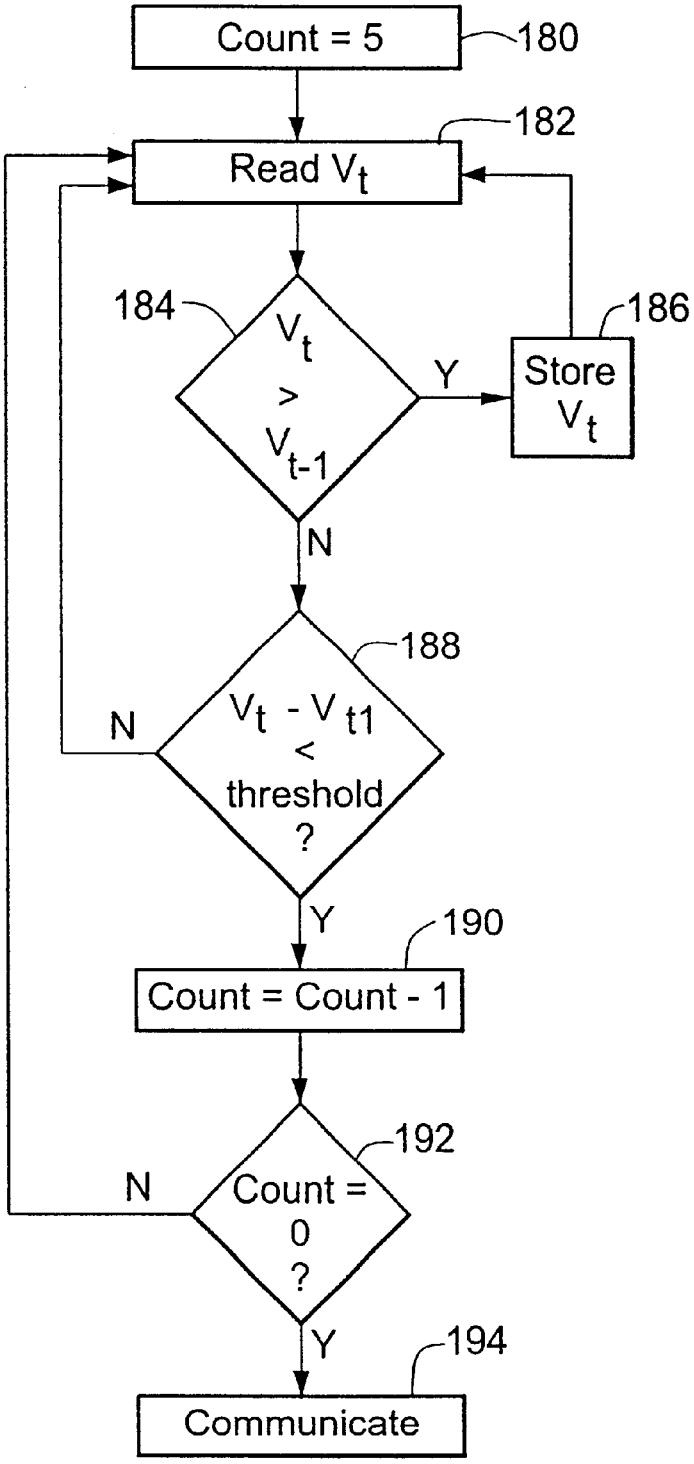
FIG. 6 is a flow chart depicting the routine for detecting cycling in accordance with this invention.
Figure 7:
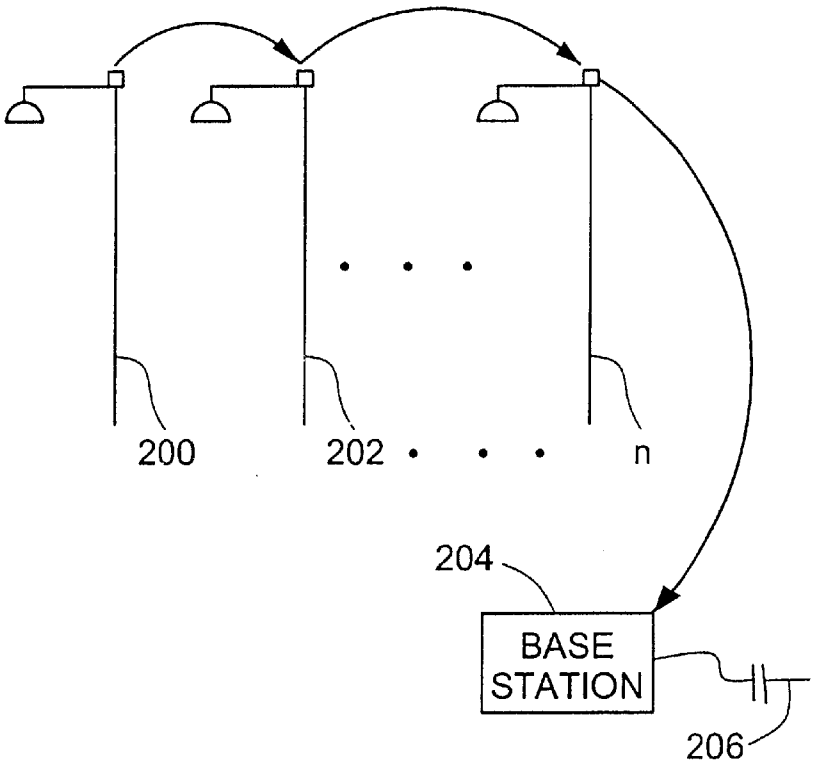
FIG. 7 is a schematic view showing one method of externally transmitting photocontroller and luminaire fault conditions diagnosed in accordance with this invention.

In accordance with this invention, microprocessor 54, FIG. 3, is also programmed in accordance with the flow charts shown is FIGS. 4, 5 and 6.

Photocontroller Diagnostics

In general, the photocontroller diagnostic section of the program is written to allow detection of photocontroller component failures. The operability of two components that the program can detect are typically photocell 120, FIG. 3 and relay 106. A faulty relay condition is defined as the current being drawn by the lamp during a certain ambient light condition, typically daylight or a day. In other cases, such as for golf course water fountains, the ambient light condition is night. A faulty photocell condition is defined by twenty-four hours of continuous daytime and nighttime lamp operation.

When power is first applied to the photocontroller, initialization step 130, FIG. 4 sets all counters. The light level is then read every 0.5 seconds in step 131. The light level read is compared to a predetermined level and a decision is made whether it is light or dark, step 132. If it is light, the next question is whether a fault has already been detected, step 133. If so, the program will go back and check light level again. If no fault has previously been detected, then the program will wait two-seconds, step 134, and then read the current, step 135. The program will then check to see if there is a current draw, step 136. If no current is drawn, then the relay is properly operating since there should be no current drawn during daylight hours. Next, the program will call the hour counter, step 137. If current is drawn, then there is a problem and one second is subtracted from the counter, step 138 and a check is made to see if hour counter is at zero, step 139. If the hour count is not zero, then the program proceeds to step 137 to call the hour counter. If the hour count is zero, then the relay is faulty, a condition which is communicated via a relay fault signal, step 140 to LED's 13 and/or 15, FIG. 1. In addition, or alternatively, the relay fault signal could be transmitted to a remote location as discussed with reference to FIGS. 7–8.

If, in step 132 it was determined that it was night, the program would next determine if it was a new night, step 141. If it is a new night, then all faults and counter and timers are reset, step 142. The program then goes on to check the light level again step 131.

If it is not a new night, then the hour counter is called, step 137. This hour counter is used to count the length of the night or day. If in step 143 it is determined that the hour counter is equal to a preset threshold, e.g., twenty-four hours, then the photocell is faulty. The program then communicates this fault, step 140 and causes LEDs 13 and/or 15, FIG. 1, to energize. Again, this faulty photocell signal could also or alternatively be communicated to a remote location as discussed below with reference to FIGS. 7–8. If the hour counter in step 143 is not equal to twenty-four hours, then the light level is checked again, step 131.

Luminaire Diagnostics

Another routine, called a lamp out detection routine, begins by reading the voltage level on line 56, FIG. 3 at some time $t_1$ after the lamp is first turned on, step 150, FIG. 5. $t_1$ is typically about 2 seconds which is sufficient time to eliminate any transients in the circuitry. At some time later, $t_2$, typically 3 minutes, the voltage is again read, step 152, and these two voltages are compared to determine whether they are lower than a preset threshold, step 154, typically about 12.5 percent. If the difference between the two different voltage level readings is greater than this threshold, processing transfers to the cycle detection mode discussed with reference to FIG. 6. If, however, on the other hand, the difference between the two different voltage readings is less than this threshold, this is indicative of a lamp out condition, step 156.

In other words, a properly working lamp consistently draws more and more of a load during the start up mode while a failed lamp or ballast does not. The threshold level for the comparison at step 154 could be zero but the 12.5 percent level is preferably used because the power correction capacitor used in the luminaire often draws a load even when the lamp is out but it always draws a constant load over time. Once microprocessor 54, FIG. 3, determines a lamp out condition, step 156, FIG. 5, it can take any number of lamp out condition actions, step 158, such as energizing LED 15, FIGS. 1 and 3, step 160, FIG. 5, provide a signal to transmitter 80, FIG. 3 to communicate to a remote base station, step 162, FIG. 5, and/or turning the power off to the lamp, step 164, to save energy and the life of the starting aid and ballast. Receiver 81 may be used as a means to activate certain routines programmed in microprocessor 54, FIG. 3 including a routine to power the lamp in daylight hours for daytime testing.

Microprocessor 54, FIG. 3, also includes the cycling detection routine shown in FIG. 6 wherein the count representing the number of cycles is set to a number such as five upon initialization, step 180, and then the voltage on line 56, FIG. 3, is read periodically at a time t such as every second, step 182. If a subsequent voltage reading is greater than a previous voltage reading, step 184, the subsequent voltage reading is stored and used as the base line, step 186. This voltage level is stored in a buffer as a bench mark so that any transients and any voltage levels read during the warm up period will be accounted for. Processing then continues until a subsequent voltage reading is lower than a previous voltage reading, step 188, by some predetermined threshold, for example, 25%, which indicates the presence of a cycling event. The 25% threshold could be as low as 12%, but a 12% variation could also be indicative of a power surge and so the 25% threshold is preferred. The count is then decremented, step 190, and once the count reaches some predetermined minimum, step 192, for example, 0, the fact that a cycling event has occurred is communicated, step 194, in a fashion similar to the actions taken after step 158, FIG. 5. The lamp can be turned off permanently or the microprocessor can be programmed to turn the lamp off only for one night and then re-set to again detect cycling the next night to prevent erroneous cycling detection events. In addition, or alternatively, LEDs 13 or 15, FIG. 1 can be made to flash, and/or a signal can be sent via transmitter 80 to a remote location to indicate the occurrence of a cycling event. An available alarm could also be used.

External communications may occur via RF transmission or via powerline carrier technology as shown in FIG. 7 from street light 200 to street light 202 to street light$_n$ whereupon the condition information is sent to final or intermediate base station 204 and, if required, to other base stations or other locations as shown at 206 in any number of ways including satellite transmission, RF transmissions, land line transmissions, and the like. Alternatively, as shown in FIG. 8, a communication network utilizing RF transmitters and/or transmitter receivers can be used wherein one set of transmitters resident on the photocontrollers described above transmit to communication control unit 210 which in turn communicates to network control node 212 which also receives communications from communication control unit 214. Network control node 212 then communicates with central base station 216 as is known in the art of remote meter reading technology. In this way, information regarding the operability of the photocontroller (faulty relay, faulty photocell) and/or the luminaire (a cycling condition, faulty lamp) can be transmitted to remote locations for real time diagnostics.

Note, however, that in one embodiment, such remote communication capabilities are not required and LEDs 13 and 15, FIGS. 1 and 3, can be the only indicators in an less expensive, less complex photocontroller in accordance with the subject invention. Note also that other types of visual and even non-visual alarm indicators could be used instead of LEDs 13 and 15. Also, additional LEDs could be used such that one signals the occurrence of a faulty relay, one signals the presence of a faulty photocell, one signals the presence of a cycling condition, and one signals a faulty lamp condition.

Thus, photocontroller 10, FIG. 1, includes sensor 120, FIG. 3 which, in combination with microprocessor 54 and the circuitry shown in FIG. 3 determines the presence of daylight. Relay means, such as relay 106 is responsive to sensor 120 via microprocessor 54, de-energizes luminaire 20, FIG. 2 during periods of daylight and energizes lamp 20 during periods of darkness. In other embodiments, such as golf course water fountains, the reverse is true and thus microprocessor 54 is programmed to turn the fountain on during the day and off at night. The relay means could also be a TRIAC, FET or other sold state device.

The diagnostic subsystem of this invention includes two primary components: a photocontroller diagnostic routine and a luminaire diagnostic route. Microprocessor 54, FIG. 3 is programmed in accordance with steps 130–143, FIG. 4 to verify the operability of relay 106, FIG. 3 and sensor 120, typically a photocell and to then transmit a signal representing a failure of either component. A faulty relay is usually detected by determining whether current is drawn by the lamp during daylight hours. A faulty photocell is usually detected by determining whether the lamp remains on or off for a preestablished time period, e.g., 24 hours.

The luminaire diagnostic routine operates in accordance with the processing steps shown in FIGS. 5 and 6. Transformer 50, FIG. 3 is used, in combination with microprocessor 54 to detect the load drawn by the lamp. This information is used both by the photocontroller diagnostic routine and the luminaire diagnostic routine.

Although specific features of this invention are shown in some drawings and not others, however, this is for convenience only as each feature may be combined with any or all of the other features in accordance with the invention. And, other embodiments will occur to those skilled in the art and are within the following claims:

What is claimed is:

1. An electrical system, comprising:

an electrically activated device;

a photocell for detecting ambient light conditions and for generating a photocell signal that varies with a magnitude of ambient light;

a relay for selectively providing power to the electrically activated device upon receipt of a control signal; and a processor for receiving the photocell signal and for generating the control signal when the magnitude of the photocell signal is at a first level;

the processor for monitoring the power being provided to the electrically activated device;

wherein the processor determines that the relay is faulty when power is being provided to the electrically activated device while the magnitude of the photocell signal is at a second level, the second level being different than the first level.

2. The electrical system of claim 1, wherein:

the electrically activated device is a lamp;

the processor generates the control signal when the magnitude of the photocell signal indicates nighttime; and the processor determines that the relay is faulty when power is being delivered to the lamp when the magnitude of the photocell signal indicates daylight.

3. The electrical system of claim 1, wherein the processor monitors a load current delivered to the electrically activated device.

4. The electrical system of claim 1, further comprising an indicator and wherein the processor activates the indicator upon detecting the faulty relay.

5. The electrical system of claim 1, further comprising a transmitter and wherein the processor transmits signals indicative of the faulty relay to a remote location through the transmitter.

6. An electrical system, comprising:

an electrically activated device;

a photocell for detecting ambient light conditions and for generating a photocell signal that varies with a magnitude of ambient light;

a relay for selectively providing power to the electrically activated device upon receipt of a control signal; and a processor for receiving the photocell signal and for generating the control signal when the magnitude of the photocell signal is at a first level;

the processor for monitoring the power being provided to the electrically activated device;

wherein the processor determines that the photocell is faulty when a status of whether power is being provided to the electrically activated device remains unchanged for an extended period of time.

7. The electrical system of claim 6, wherein:

the electrically activated device is a lamp;

the processor generates the control signal when the magnitude of the photocell signal indicates nighttime; and the processor determines that the photocell is faulty when power is provided to the lamp for 24 hours.

8. The electrical system of claim 6, wherein:

the electrically activated device is a lamp;

the processor generates the control signal when the magnitude of the photocell signal indicates nighttime; and the processor determines that the photocell is faulty when power is not provided to the lamp for 24 hours.

9. The electrical system of claim 6, wherein the status of whether power is being provided is one of power being provided during the entire extended period of time or power is not provided during any of the extended period of time.

10. The electrical system of claim 6, further comprising an indicator and wherein the processor activates the indicator upon detecting the faulty photocell.

11. The electrical system of claim 6, further comprising a transmitter and wherein the processor transmits signals indicative of the faulty photocell to a remote location through the transmitter.

12. A luminaire, comprising:

a lamp;

a photocell for detecting ambient light conditions and for generating a photocell signal that varies with a magnitude of ambient light;

a relay for selectively providing power to the lamp upon receipt of a control signal; and a processor for receiving the photocell signal and for generating the control signal when the magnitude of the photocell signal indicates nighttime;

the processor for monitoring the power being provided to the electrically activated device;

the processor determines that the photocell is faulty when a status of whether power is being provided to the lamp remains unchanged for an extended period of time; and the processor determines that the relay is faulty when power is being provided to the lamp while the magnitude of the photocell signal indicates daylight.

13. The luminaire of claim 12, wherein the processor monitors the load being provided to the lamp during a start-up mode and detects failure of the lamp when the load decreases during the start-up mode.

14. The luminaire of claim 12, wherein the processor monitors the load being provided to the lamp during a start-up mode and determines that the lamp is cycling when a change in the load exceeds a threshold percentage for a predetermined number of times.

15. The luminaire of claim 12, further comprising an indicator and wherein the processor activates the indicator upon detecting any one of the faulty relay or the faulty photocell.

16. The luminaire of claim 12, further comprising a transmitter and wherein the processor transmits signals indicative of a fault to a remote location through the transmitter upon detecting any one of the faulty relay or the faulty photocell.

* * * * *

UNITED STATES PATENT AND TRADEMARK OFFICE

CERTIFICATE OF CORRECTION

PATENT NO. : 6,452,339 B1
DATED : September 17, 2002
INVENTOR(S) : Morrissey et al.

It is certified that error appears in the above-identified patent and that said Letters Patent is hereby corrected as shown below:

Column 10,
Line 5, delete "sold" and substitute -- solid -- therefor

Signed and Sealed this

Thirtieth Day of March, 2004

JON W. DUDAS
*Acting Director of the United States Patent and Trademark Office*